US011583980B2

(12) United States Patent
Doroslovac

(10) Patent No.: US 11,583,980 B2
(45) Date of Patent: Feb. 21, 2023

(54) ADAPTABLE WRENCH FOR DAMAGE FASTENER ENGAGEMENT HEAD

(71) Applicant: Robert Doroslovac, Massillon, OH (US)

(72) Inventor: Robert Doroslovac, Massillon, OH (US)

(73) Assignee: BGD Unlimited, LLC, Thonotosassa, FL (US)

( * ) Notice: Subject to any disclaimer, the term of this patent is extended or adjusted under 35 U.S.C. 154(b) by 330 days.

(21) Appl. No.: 16/993,705

(22) Filed: Aug. 14, 2020

(65) Prior Publication Data

US 2021/0046617 A1 Feb. 18, 2021

Related U.S. Application Data

(60) Provisional application No. 62/887,171, filed on Aug. 15, 2019.

(51) Int. Cl.
*B25B 13/08* (2006.01)
*B25B 23/10* (2006.01)

(52) U.S. Cl.
CPC ..... *B25B 13/08* (2013.01); *B25B 23/10* (2013.01)

(58) Field of Classification Search
None
See application file for complete search history.

(56) References Cited

U.S. PATENT DOCUMENTS

| | | | | | |
|---|---|---|---|---|---|
| 1,626,809 | A | | 5/1927 | Gillett | |
| 2,652,735 | A | | 9/1953 | Wilder | |
| 3,762,244 | A | * | 10/1973 | Evans | B25B 13/08 81/119 |
| 4,776,244 | A | * | 10/1988 | Olson | B25B 13/08 81/124.2 |
| 5,860,339 | A | * | 1/1999 | Mikic | B25B 13/04 81/186 |
| 5,953,968 | A | * | 9/1999 | Macor | B25B 13/46 81/186 |
| 6,082,228 | A | | 7/2000 | Macor | |
| 2019/0015961 | A1 | | 1/2019 | Kukucka et al. | |

FOREIGN PATENT DOCUMENTS

| | | | | |
|---|---|---|---|---|
| WO | WO-0010773 A2 | * | 3/2000 | B25B 13/08 |

* cited by examiner

*Primary Examiner* — Brian D Keller
(74) *Attorney, Agent, or Firm* — Harpman & Harpman

(57) ABSTRACT

An improved open-ended wrench that is adaptable for engaging hexagonal head nuts with non-specific engagement surfaces. The wrench provides a handle with an open working end having opposed flat jaw working surfaces with a positional work piece engagement cavity there between. A contact enabling contoured notch cutout in each flat inside working surface with corresponding standard and non-standard support and torque engagement surface respectively inwardly from the junction of the concave cavity portion.

4 Claims, 2 Drawing Sheets

ADAPTABLE WRENCH FOR DAMAGE FASTENER ENGAGEMENT HEAD

This application claims the benefit of U.S. Provisional Application No. 62/887,171, filed on Aug. 15, 2019.

BACKGROUND OF THE INVENTION

1. Technical Field

This invention relates to hand tools, specifically wrenches of the open-end configuration that are engageable on bolts, nuts and various fasteners.

Fastener engagement wrenches of this open-ended wrench head type are used to selectively engage and rotate under torque fasteners. Such wrenches are subject to non-surface fastener head use when the pristine hexagonal head, for example, is disfigured and damaged, typically due to improper tool engagement and rotational resistance of the fastener during threaded insertion or more often during attempted rotational removal. Such "rounded off" fastener head edge surfaces makes it difficult to engage and remove the fastener.

2. Description of Prior Art

Prior art devices of this type have been developed to ensure better fastener grip and therefore the effective use of the tool in open head wrench configurations.

Such examples of different open-end wrenches can be seen in U.S. Pat. Nos. 1,626,809, 2,652,735, 3,762,244, 5,953,968, 6,082,228 and U.S. Publication 2019/0015961.

U.S. Pat. No. 1,626,809 is directed to an open-ended wrench having multiple angular notches in annular aligned end to end relation about its open jaw cavity.

U.S. Pat. No. 2,652,735 discloses an open-ended wrench with opposing jaws having flat and contoured surfaces with interconnecting angular adjoining flat surfaces.

U.S. Pat. No. 3,762,244 claims a speed wrench with upper and lower jaw portions and inner wrench surfaces of unique configurations for ratchet engagement about and on a fastener.

U.S. Pat. No. 5,953,968 illustrates a surface conforming torque enhancing wrench where surface of each jaw pairs forms a surface contact angle with each other.

U.S. Pat. No. 6,082,228 shows a unidirectional open-end wrench having four principle interval engaging surfaces about a defined center axis.

Finally, in U.S. Patent Publication 2019/0015961, an anti-slip torque tool is disclosed having a plurality of grooves to prevent slippage with multiple internal sidewalls and corresponding bracing surfaces.

SUMMARY OF THE INVENTION

The present invention discloses an adaptable high engagement torque open ended wrench head which can adjustably engage a fastener in damaged and pristine head condition with substantial torque capacity, as needed. Opposing parallel internal sidewalls have staggered offset contoured cutout notches and a concave portion extending therefrom within the wrench head delineating fastener receiving cavity there between with the so defined opposing wrench jaws. Inner opposing fastener engagement jaw surfaces support non-damaged and damaged fastener head surfaces respectively.

DETAILED DESCRIPTION OF THE INVENTION

Figure 1:
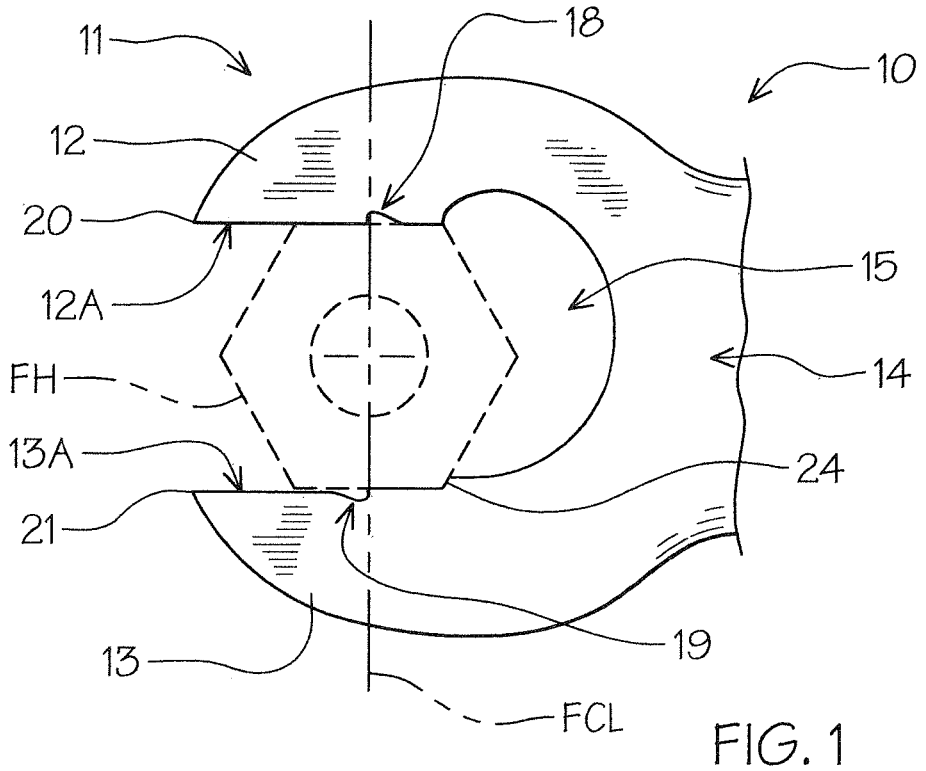
FIG. 1 is an enlarged top plan view of the adaptable wrench of the invention with a fastener shown in broken lines engaged therein.
Figure 2:
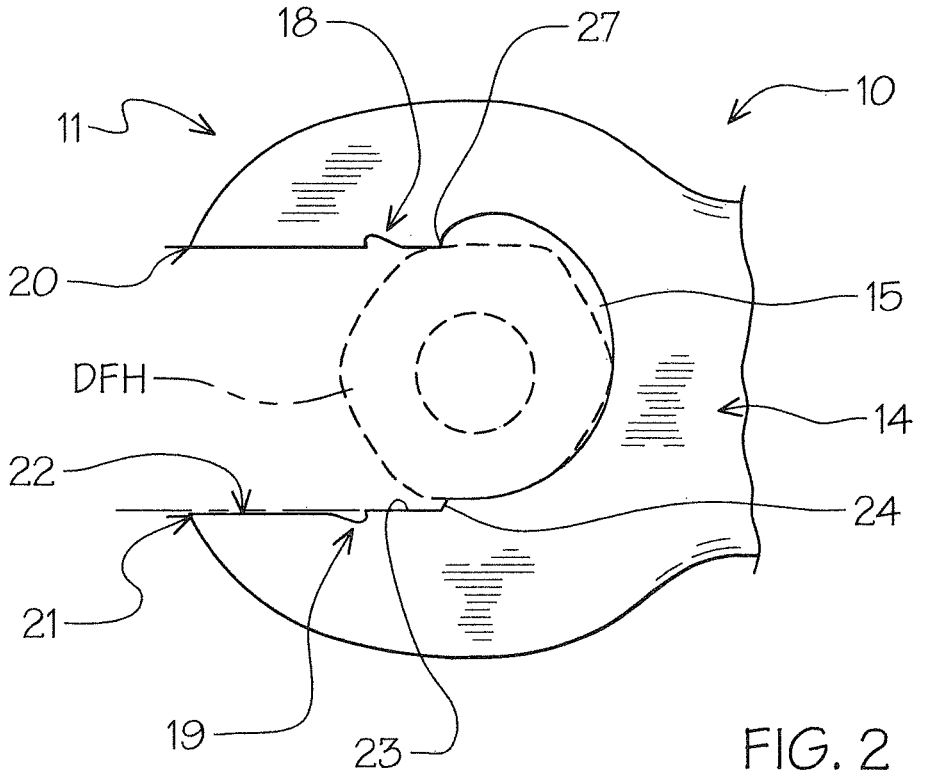
FIG. 2 is an enlarged top plan view thereof with the damaged fastener shown in broken lines engaged within.

Referring to FIGS. 1 and 2 of the drawings, an enlarged portion of an adaptable wrench 10 of the invention can be seen having a wrench head 11 with an upper jaw portion 12 and a lower jaw portion 13, each having inner engagement surfaces 12A and 13A respectively.

The jaw portions 12 and 13 are in spaced parallel alignment to one another along a longitudinal axis of the tool's handle portion 14 extending therefrom as will be well understood by those skilled in the art.

A concave cavity 15 is of a generally annular configuration and is formed within the wrench head 11 extending from the so defined jaw portions 12 and 13 to afford a space for a fastener head FH to be engaged, illustrated in broken lines as will be described in greater detail hereinafter.

The inner effacing parallel engagement surfaces 12A and 13A of the jaw portions 12 and 13 each have a respective curved cut away notch 18 and 19 therein which are spaced inwardly from the respective jaws end portions 20 and 21.

Figure 3:
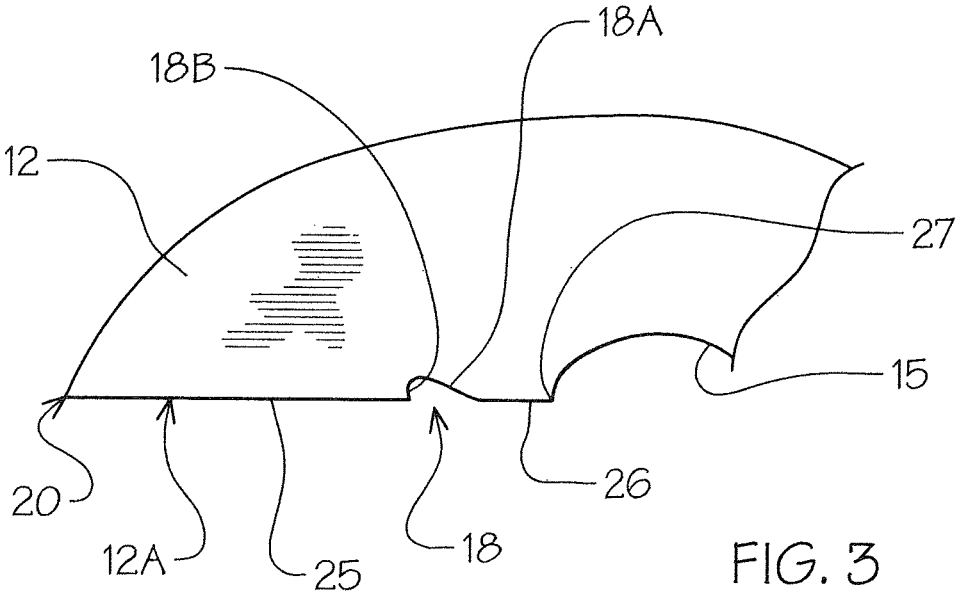
FIG. 3 is an enlarged partial top plan view of an upper jaw engagement portion thereof.
Figure 4:
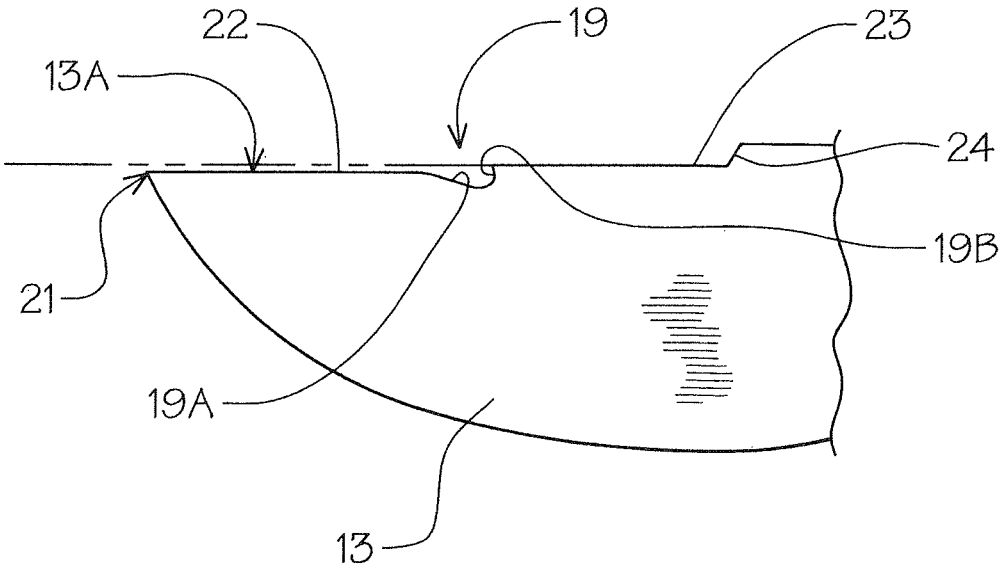
FIG. 4 is an enlarged partial top plan view of the lower jaw engagement portion thereof.

Each of the cut away notches 18 and 19 are comprised of a tapered recess portion 18A and 19A respectively which transitions to respective curved ends 18B and 19B as best seen in FIGS. 3 & 4 of the drawings.

The notches 18 and 19 are in reverse orientation within their inner engagement surfaces 12A and 13A with the lower jaw notch 19 tapered recess portion 19A facing outwardly to its respective jaw end 21.

Correspondingly, the upper jaw portion 12, notch 18, tapered recess portion 18A faces inwardly towards the concave cavity 15.

The notches 18 and 19 are also positionally offset vertically along a vertical defined fastener engagement center line FCL as seen in FIG. 1 of the drawings for illustration.

The positional orientation of the respective notches 18 and 19 are critical to afford successful engagement of both damaged and non-damaged fastener heads as so illustrated in FIGS. 1 and 2 of the drawings in broken lines.

It will be seen that a flat portion 22 of the lower jaw 13 inner engagement portion 13A extends from the notched tapered recess portion 19A is proportionally lower on a horizontal plane than its remaining flat surface 23 extending from the notch 19 which terminates in an angular upstanding fastener registration surface 24.

Referring now to the upper jaw portion 12, its inner engagement surface 12A correspondingly the flat engagement surfaces 25 and 26 are on a continuous horizontal plane continuing in defined fastener engagement portion 27 at the junction with the beginning of the hereinbefore described concave cavity 15, as best seen in FIG. 2 of the drawings and is for use with damaged fastener heads DFH shown in broken lines to be positioned there within.

In use, the adaptive wrench 10 of the invention's upper and lower inner engagement surfaces 12A and 13A provide for secure and workable engagement of size fastener heads which are non-damaged as seen in FIG. 1 of the drawings and damaged as illustrated in FIG. 2 of the drawings in broken lines. The combination of the unique tapered recess notches 18 and 19 in reverse orientation and being positionally offset vertically to one another with their corresponding fastener head engagement point 27 and upstanding fastener registration surface 24 respectively as described afford a wrench head configuration of superior performance and engagement practicality.

It will thus be seen that a new and novel adapted open-ended wrench configuration has been illustrated and described and that various changes and modifications may be made thereto without departing from the spirit of the invention.

Therefore, I claim:

1. A one-piece open end wrench head with upper and lower jaw portions in spaced parallel relation, each having a pair of respective parallel inner engagement surfaces therewithin, a concave cavity within said wrench head from said respective jaw portions, said respective pairs of inner engagement surfaces being flat, said upper jaw portion inner engagement surfaces pairs extending respectively inwardly from an open end of said wrench head and outwardly from said concave cavity, said lower jaw portion inner engagement surface pairs extending respectively inwardly from an open end of said wrench head and outwardly from an angular upstanding fastener registration surface at the junction of said concave cavity, a pair of engagement notches in spaced vertical offset relation to one another between said respective inner pairs of jaw portion engagement surfaces, each of said engagement notches having a tapered recess therein in oppositely disposed facing relation to one another, a fastener head engagement portion at a junction of said concave cavity and said flat engagement surface extending from said engagement notch in said upper jaw inner engagement surface.

2. The wrench head of claim 1 wherein said upper jaw portion's pair of inner engagement surfaces are flat on horizontal planes extending from said open end of said wrench head to a fastener head engagement point.

3. The wrench head of claim 1 wherein said lower jaw portion's respective flat inner engagement surface extending inwardly from said open end of said wrench head is on a respective lower horizontal plane than said pairs flat engagement surface extending from said engagement notch to said angular upstanding fastener registration surface at the junction of said concave cavity.

4. The wrench head of claim 1 wherein said flat engagement surface extending from said lower jaw portion engagement notch is longer than said flat engagement surface extending from said upper jaw portion engagement notch to said concave cavity.

* * * * *